US007528826B2

(12) United States Patent
Lee et al.

(10) Patent No.: US 7,528,826 B2
(45) Date of Patent: May 5, 2009

(54) DRIVING CIRCUIT FOR DRIVING LIQUID CRYSTAL DISPLAY PANEL

(75) Inventors: Cheung Fai Lee, Sheung Shui (HK); Yiu Sang Lei, Kowloon (HK)

(73) Assignee: Solomon Systech Limited, New Territories (HK)

( * ) Notice: Subject to any disclaimer, the term of this patent is extended or adjusted under 35 U.S.C. 154(b) by 799 days.

(21) Appl. No.: 11/203,113

(22) Filed: Aug. 15, 2005

(65) Prior Publication Data

US 2007/0035499 A1 Feb. 15, 2007

(51) Int. Cl.
*G09G 5/00* (2006.01)

(52) U.S. Cl. ..... 345/204

(58) Field of Classification Search ..... 345/52, 345/87, 92–95, 98–100, 104, 204, 206, 211–213; 315/169.1, 169.2
See application file for complete search history.

(56) References Cited

U.S. PATENT DOCUMENTS 5,754,151 A * 5/1998 Moon ..... 345/92
6,166,714 A 12/2000 Kishimoto
6,756,958 B2 * 6/2004 Furuhashi et al. ..... 345/95
6,762,565 B2 * 7/2004 Kudo et al. ..... 315/169.2
2005/0195149 A1 * 9/2005 Ito ..... 345/98

OTHER PUBLICATIONS http://www.national.com/onlineseminar/2002/column_drivers/PresentationFiles/userPlaceholder.html.

* cited by examiner

*Primary Examiner*—Sumati Lefkowitz
*Assistant Examiner*—Rodney Amadiz
(74) *Attorney, Agent, or Firm*—Finnegan, Henderson, Farabow, Garrett & Dunner LLP

(57) ABSTRACT

A driving circuit for driving a display panel including a plurality of cells arranged in rows. The driving circuit comprises a gate electrode driving circuit to provide a gate voltage to a row of cells, a common electrode driving circuit to provide a common voltage to the row of cells, and an external capacitor coupled to the gate electrode driving circuit and the common electrode driving circuit to provide an additional gate voltage to the row of cells. The external capacitor is charged by a potential difference between the common voltage and the gate voltage.

6 Claims, 7 Drawing Sheets

600

DRIVING CIRCUIT FOR DRIVING LIQUID CRYSTAL DISPLAY PANEL

DESCRIPTION OF THE INVENTION

FIELD OF THE INVENTION

The present invention generally relates to a driving circuit for driving a display panel, and, more particularly, to a driving circuit for driving a Cs-on-gate (storage capacitor on gate) type liquid crystal display panel.

BACKGROUND OF THE INVENTION

A liquid crystal display (LCD) panel has a structure in which liquid crystal molecules are held between an array substrate and a counter substrate. The array substrate has a plurality of pixel electrodes and the counter substrate has a plurality of common electrodes. Each common electrode on the counter substrate is opposed against one of the pixel electrodes on the array substrate. The LCD panel includes cells arranged in a matrix form. Each cell incorporates one of the pixel electrodes and one of the common electrodes.

FIG. 1 illustrates an equivalent circuit for a conventional LCD panel 100 and its driving circuit. Conventional LCD panel 100 includes a plurality of data lines such as D(m), D(m+1), and D(m+2), and gate lines such as G(n), G(n+1), and G(n+2). Conventional LCD panel 100 includes a matrix of cells arranged in rows and columns. Each cell includes a thin film transistor (TFT) 10 coupled to one of gate lines (G) and one of data lines (D). The drain electrodes of TFTs 10 of the cells which are in the same column are connected to an associated data line (D), and the gate electrodes of TFTs 10 of the cells which are in the same row are connected to an associated gate line (G). The source electrode of each TFT 10 is connected to a pixel electrode 12. For example, a cell labeled (Xm,Yn) in FIG. 1 includes one of TFTs 10. The drain electrode of TFT 10 of cell (Xm,Yn) is connected to data line D(m), the gate electrode of TFT 10 of cell (Xm,Yn) is connected to gate line G(n), and the source electrode of TFT 10 of cell (Xm,Yn) is connected to one of pixel electrodes 12. For cell (Xm,Yn), a liquid crystal capacitor Clc is formed by its pixel electrode 12 and a common electrode on a counter substrate which is opposite to an array substrate of conventional LCD panel 10. A parasitic capacitor Cgs is formed between the gate and the source electrodes of TFT 10. A storage capacitor Cs of cell (Xm,Yn) is formed between its pixel electrode 12 and gate line G(n+1) which is adjacent to gate line G(n). Conventional LCD panel 100 has a wiring arrangement in which gate line G(n+1) concurrently serves as one common electrode of storage capacitors (Cs) on gate line G(n). This type of LCD panel is called a "Cs-on-gate" type LCD panel and LCD panel 100 is a "Cs-on-gate" type LCD panel.

With reference to FIG. 1, a driving circuit of LCD panel 100 includes an X-driver 110 for providing scanning voltages (Vg) to gate lines (G), a Y-driver 120 for providing driving voltages to data lines (D), and a common electrode driver 130 for providing common voltages (Vcom) to the counter electrodes. X-driver 110 provides scanning voltages (Vg) to LCD panel 100 via gate lines (G) for driving cells sequentially line by line. Y-driver 120 simultaneously provides driving voltages corresponding to image data to each cell of the same line which are turned ON by scanning voltage (Vg). Common electrode driver 130 provides the common voltage (Vcom) to each cell of LCD panel 100 as a reference voltage. By applying scanning voltages, driving voltages, and common voltages to the cells of LCD panel 100, a potential difference is created between pixel electrode 12 and the common electrode of each cell when drivers 110, 120, and 130 drive LCD panel 100. In this condition, liquid crystal molecules filled between pixel electrode 12 and the common electrode of each cell are tilted by an angle which is proportional to the potential difference between pixel electrode 12 and the common electrode so that a specific amount of light can pass through the cell. Thus, the light transmittance of each cell of LCD panel 100 is determined by the potential difference between its pixel electrode 12 and common electrode, which is controlled by the scanning voltage, common voltage, and driving voltage applied to the cell.

When driving cells of LCD panel 100, it is common to intermittently invert the polarity of the potential difference applied to pixel and common electrodes to prevent damage. A line common inversion driving method is often employed in which the polarity of the potential difference is inverted every line period. The polarity of the potential difference is determined by using common voltage (Vcom) as a reference. FIGS. 2 and 3 illustrate driving waveforms of the common voltage (Vcom) and the scanning voltage (Vg) applied to a conventional LCD panel such as panel 100 employing the line common inversion driving method. FIG. 2 illustrates driving waveforms of the common voltage (Vcom) and the scanning voltage (Vg) used to drive inverted lines of conventional LCD panel 100 and FIG. 3 illustrates driving waveforms of the common voltage (Vcom) and the scanning voltage (Vg) used to drive non-inverted lines of conventional LCD panel 100. With reference to FIGS. 2 and 3, Vcom represents voltage levels of common voltages applied to the common electrodes. In conventional LCD panel 100 employing the line common inversion driving method, the voltage level of the common voltages change from a high voltage level (VCOMH) to a low voltage level (VCOML) when driving inverted lines of LCD panel 100 and change from VCOML to VCOMH when driving non-inverted lines of LCD panel 100.

With reference to FIG. 2, Vg of FIG. 2 represents voltage levels of a scanning voltage applied to an inverted line of cells of LCD panel 100. When turning ON the cells of the inverted line of LCD panel 100, a large positive gate-on voltage VGON is applied to the cells of the inverted line of LCD panel 100. With reference to FIG. 3, Vg of FIG. 3 represents voltage levels of a scanning voltage applied to a non-inverted line of cells of LCD panel 100. When turning ON the cells of the non-inverted line of LCD panel 100, a large positive gate-on voltage VGON is applied to the cells of the non-inverted line of LCD panel 100. With reference again to FIGS. 2 and 3, when the line of cells is OFF, a negative gate-off voltage VGOFF is applied to the line of cells. In conventional LCD panel 100 which employs the line common inversion driving method, the voltage level of the gate-off voltage VGOFF changes from a high voltage level (VGOFFH) to a low voltage level (VGOFFL) when the driving circuit drives each inverted line of LCD panel 100 and changes from VGOFFL to VGOFFH when the driving circuit drives each non-inverted line of LCD panel 100.

In order to decrease effective potential differences between non-inverted lines and inverted lines, the high/low phase of the gate-off scanning voltage (VGOFF) applied to a line of cells is identical with that of the common electrode voltage (VCOM) applied to the line of cells. That is, when the voltage level of the gate-off voltage (VGOFF) applied to a line of cells is high (VGOFFH), the voltage level of common electrode voltage (Vcom) applied to the line of cells is also high (VCOMH). When the voltage level of the gate-off voltage (VGOFF) applied to a line of cells is low (VGOFFL), the voltage level of the common electrode voltage (Vcom) applied to the line of cells is also low (VCOML), as shown in FIGS. 2 and 3.

FIG. 4 illustrates a conventional gate electrode driving circuit 400 for applying gate voltages (Vg) to drive a line of cells of LCD panel 100. Conventional gate electrode driving circuit 400 is a portion of X-driver 110. Conventional gate electrode driving circuit 400 includes a VGOFFH buffer 402 to apply a gate-on voltage VGON when turning ON the line of cells coupled to conventional gate electrode driving circuit 400 and apply a high level of a gate-off voltage VGOFFH when the line of cells coupled to conventional gate electrode driving circuit 400 is OFF. Conventional gate electrode driving circuit 400 further includes a VGOFFL buffer 404 to apply a gate-on voltage VGON when turning ON the line of cells coupled to conventional gate electrode driving circuit 400 and apply a low level of a gate-off voltage VGOFFL when the line of cell coupled to conventional gate electrode driving circuit 400 is OFF. The voltage level of the gate-off voltage VGOFF outputted to the line of cell is controlled by a GSWH switch 406 and a GSWL switch 408. When driving circuit drives non-inverted lines of LCD panel 100 and the line of cell coupled to conventional gate electrode driving circuit 400 is OFF, GSWH switch 406 is turned ON and GSWL switch 408 is turned OFF so that VGOFFH buffer 402 outputs VGOFFH to drive a capacitor load (Cgoff) of the line of cells coupled to conventional gate electrode driving circuit 400. When driving circuit drives inverted lines of LCD panel 100 and the line of cell coupled to conventional gate electrode driving circuit 400 is OFF, GSWH switch 406 is turned OFF and GSWL switch 408 is turned ON so that VGOFFL buffer 404 outputs VGOFFL to drive the capacitor load (Cgoff) of the line of cell coupled to conventional gate electrode driving circuit 400. Cgoff represents the total of the capacitances of Cgs of the line of cells coupled to conventional gate electrode driving circuit 400. FIG. 5 illustrates exemplary voltage levels of gate-off voltage VGOFF. With reference to FIG. 5, the voltage level of VGOFFH is −7.5volt and the voltage level of VGOFFL is −12volt.

VGON is a positive voltage and both of VGOFFH and VGOFFL are negative voltages. Typically, the magnitude of VGOFFL can be one of (−3)xVIN, (−4)xVIN, (−5)xVIN, and (−6)xVIN. The magnitude of VGOFFH is equal to VGOFFL +|VCOMH-VCOML|. The magnitude of VGON can be one of (+3)xVIN, (+4)xVIN, (+5)xVIN, and (+6)xVIN. VIN is an external input voltage to supply the power to a system incorporating LCD panel 100. For example, batteries can be used to be the external power source to supply VIN to LCD panel 100. Since the magnitude of VGOFFH and VGOFFL are much larger than VIN, VGOFFH buffer 402 and VGOFFL buffer 404 of conventional gate electrode driving circuit 400 must employ a high voltage driving circuit to be able to provide a large positive voltage (VGON) and a large negative voltage (VGOFF) as well as to provide sufficient power to drive capacitor load Cgoff. As a result, the power consumption of conventional gate electrode driving circuit 400 is high in generating VON, VGOFFH and VGOFFL with the magnitudes much larger then receiving input voltage VIN. In addition, the high voltage driving circuit must employ a large chip area to provide VGON, VGOFFH, and VGOFFL, and drive capacitor load Cgoff, which increases the cost of manufacturing conventional gate electrode driving circuit 400.

There is thus a general need in the art for a circuit for driving a LCD panel which requires a minimal chip area and has a relatively low power consumption that overcomes one or more of the deficiencies of conventional driving circuits.

SUMMARY OF THE INVENTION

In accordance with the present invention, there is provided a driving circuit for driving a display panel. The display panel includes a plurality of cells arranged in rows. The driving circuit comprises a gate electrode driving circuit to provide a gate voltage to a row of cells, a common electrode driving circuit to provide a common voltage to the row of cells, and an external capacitor coupled to the gate electrode driving circuit and the common electrode driving circuit to provide an additional gate voltage to the row of cells. The external capacitor is charged by a potential difference between the common voltage and the gate voltage.

Also, in accordance with the present invention, there is provided a driving method for driving a display panel. The display panel includes a driving circuit and a plurality of cells arranged in rows. The driving circuit comprises a gate electrode driving circuit to provide a gate voltage to a row of cells. The gate electrode driving circuit includes a first buffer to provide a first level of the gate voltage, a second buffer to provide a second level of the gate voltage, a first switch to selectively couple the first buffer to an output of the gate electrode driving circuit, and a second switch to selectively couple the second buffer to the output of the gate electrode driving circuit. The driving circuit also includes a common electrode driving circuit to provide a common voltage to the row of cells. The common electrode driving circuit includes a third buffer to provide a first level of the common voltage, a fourth buffer to provide a second level of the common voltage, a third switch to selectively couple the third buffer to an output of the common gate electrode driving circuit, and a fourth switch to selectively couple the fourth buffer to the output of the common electrode driving circuit. The driving circuit further includes an external capacitor couple between the output of the gate electrode driving circuit and the output of the common electrode driving circuit to provide an additional gate voltage to the row of cells. The method comprises turning ON the first and the third switches to respectively couple the first buffer and the third buffer to the external capacitor to charge the external capacitor with a difference between the first level of the common voltage and the first level of the gate voltage, and turning ON the second and the fourth switches to respectively couple the second buffer and the fourth buffer to the external capacitor to charge the external capacitor with a difference between the second level of the common voltage and the second level of the gate voltage. Only one of the first and second switches is turned ON and only one of the third and fourth switches is turned ON.

Further, in accordance with the present invention, there is provided a driving method for driving a display panel. The display panel includes a driving circuit and a plurality of cells arranged in rows. The driving circuit comprises a gate electrode driving circuit to provide a gate voltage to a row of cells. The gate electrode driving circuit includes a first buffer to provide a first level of the gate voltage, and a first switch to selectively couple the first buffer to an output of the gate electrode driving circuit. The driving circuit also includes a common electrode driving circuit to provide a common voltage to the row of cells. The common electrode driving circuit includes a second buffer to provide a first level of the common voltage, a third buffer to provide a second level of the common voltage, a second switch to selectively couple the second buffer to an output of the common gate electrode driving circuit, and a third switch to selectively couple the third buffer to the output of the common electrode driving circuit. The driving circuit further includes an external capacitor coupled between the output of the gate electrode driving circuit and the output of the common electrode driving circuit to provide an additional gate voltage to the row of cells. The method comprises turning ON the first and the second switches to respectively couple the first buffer and the second buffer to the external capacitor to charge the external capacitor with a difference between the first level of the common voltage and the first level of the gate voltage, and turning ON the third switch to couple the third buffer to the external capacitor to charge the external capacitor with the second level of the common voltage. Only one of the second and third switches is turned ON.

Additional features and advantages of the invention will be set forth in part in the description which follows, and in part will be obvious from the description, or may be learned by practice of the invention. The features and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and, together with the description, serve to explain the principles of the invention.

DESCRIPTION OF THE EMBODIMENTS

Reference will now be made in detail to embodiments of the invention, which are illustrated in the accompanying drawings. Wherever possible, the same reference numbers will be used throughout the drawings to refer to the same or like parts.

Figure 1:
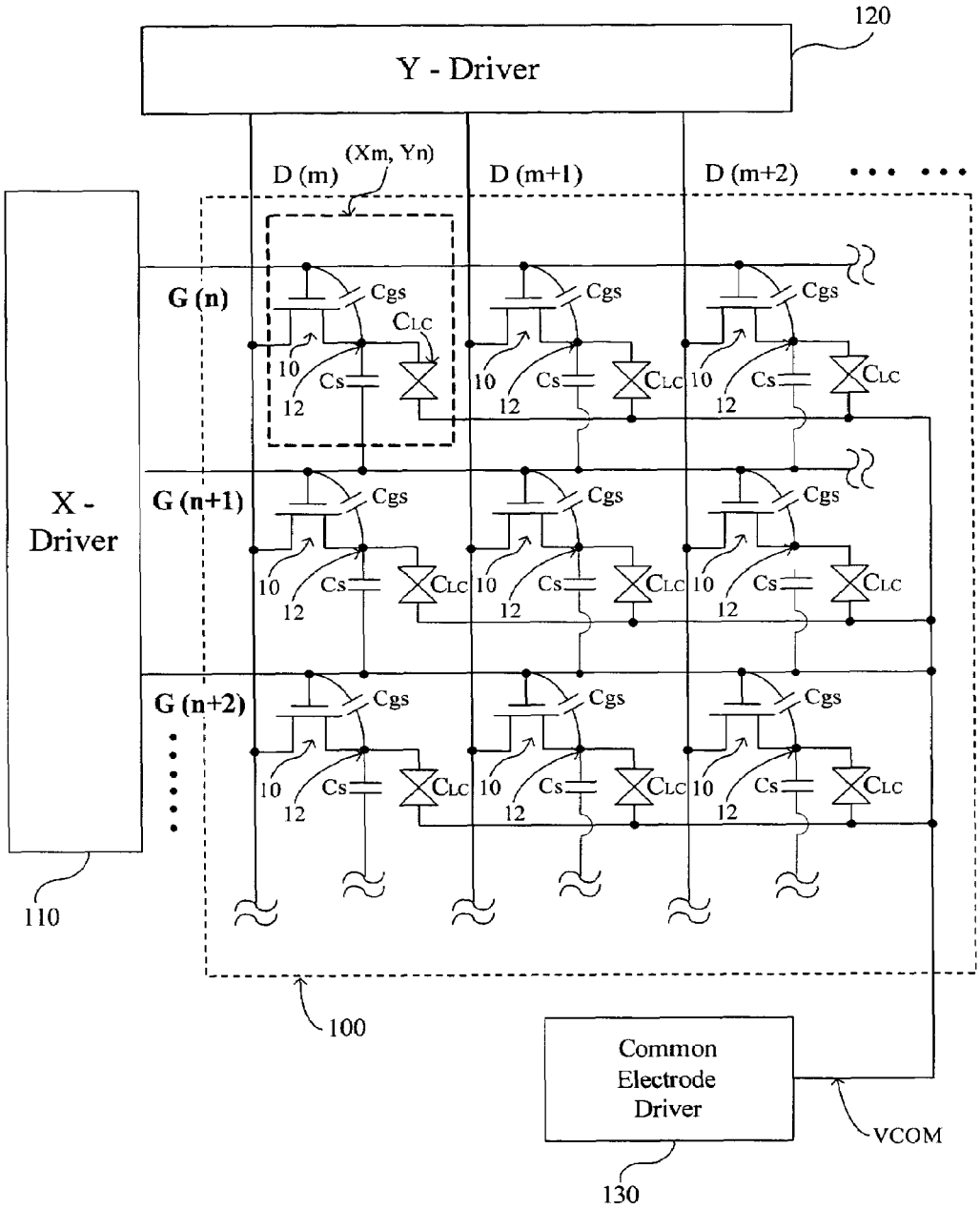
Fig. 1 (Prior Art)
FIG. 1 is a diagram illustrating an equivalent circuit for a conventional LCD panel 100.
Figure 2:
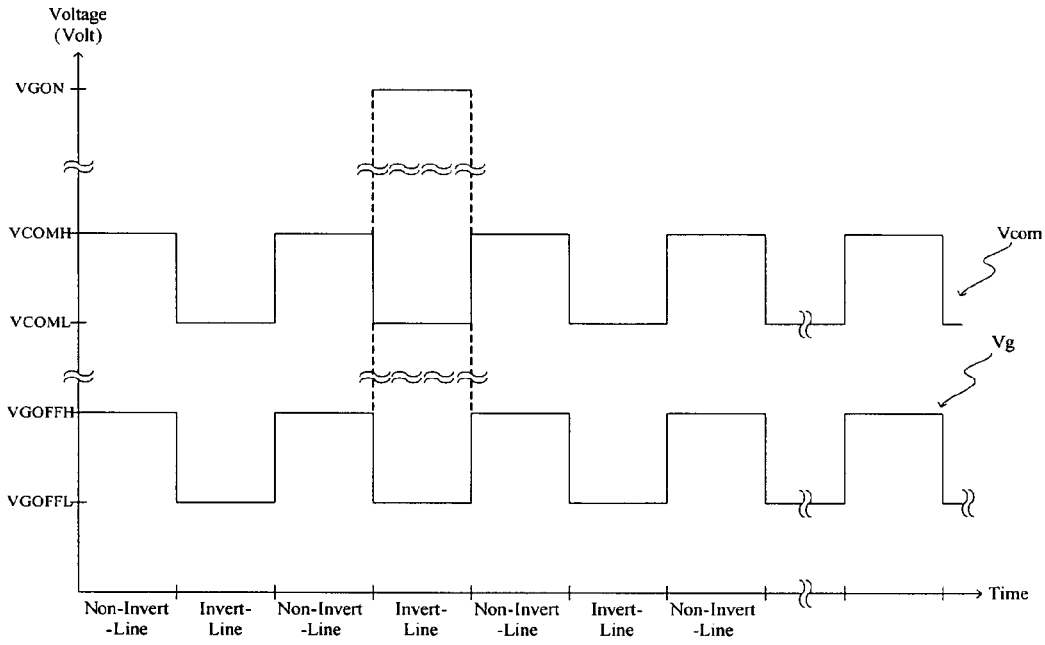
Fig. 2 (Prior Art)
FIG. 2 is a diagram illustrating driving waveforms used to drive inverted lines of the conventional LCD panel shown in FIG. 1.
Figure 3:
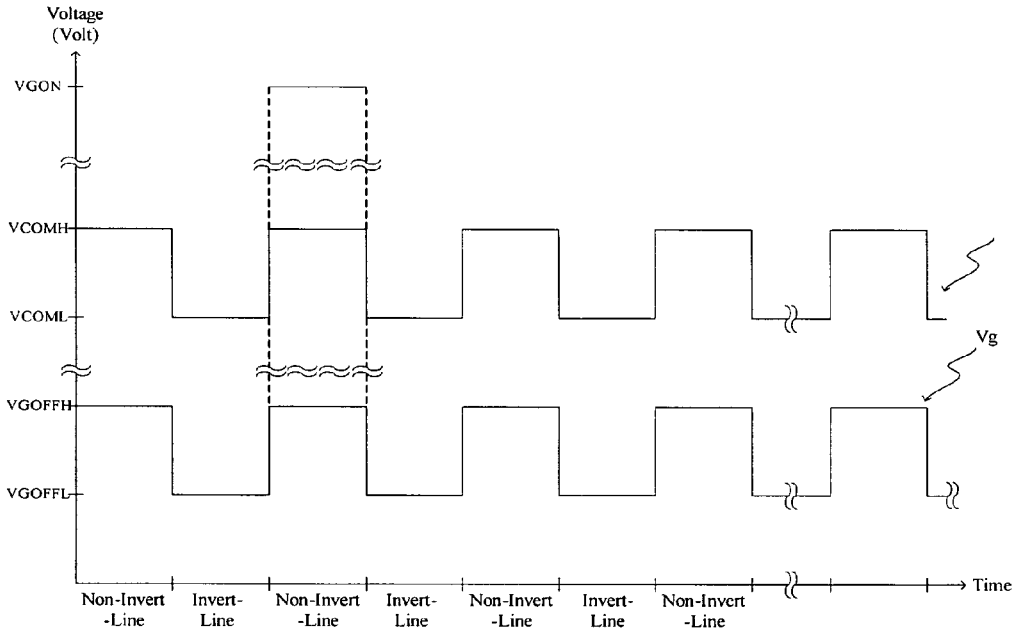
Fig. 3 (Prior Art)
FIG. 3 is a diagram illustrating driving waveforms used to drive non-inverted lines of the conventional LCD panel shown in FIG. 1.
Figure 4:
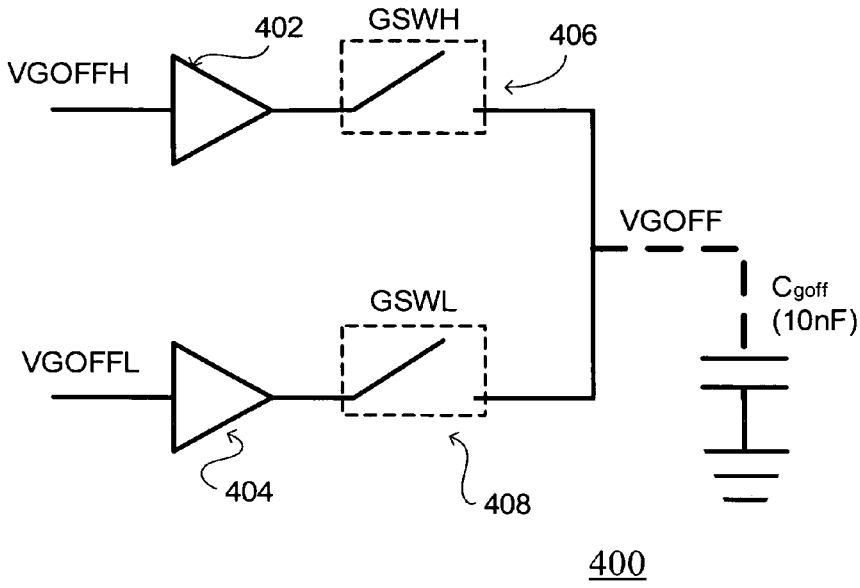
Fig. 4 (Prior Art)
FIG. 4 is a diagram illustrating a conventional gate electrode driving circuit for driving a line of cells of the conventional LCD panel.
Figure 5:
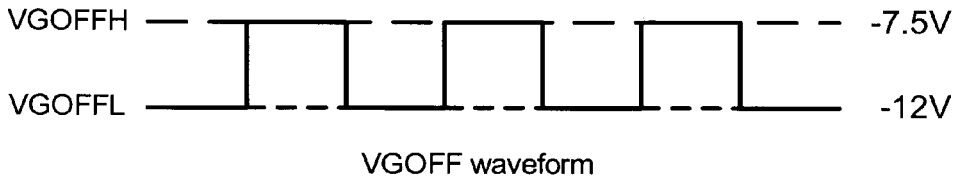
Fig. 5 (Prior Art)
FIG. 5 is a diagram illustrating exemplary voltage levels of a gate-off voltage (VGOFF)
Figure 6:
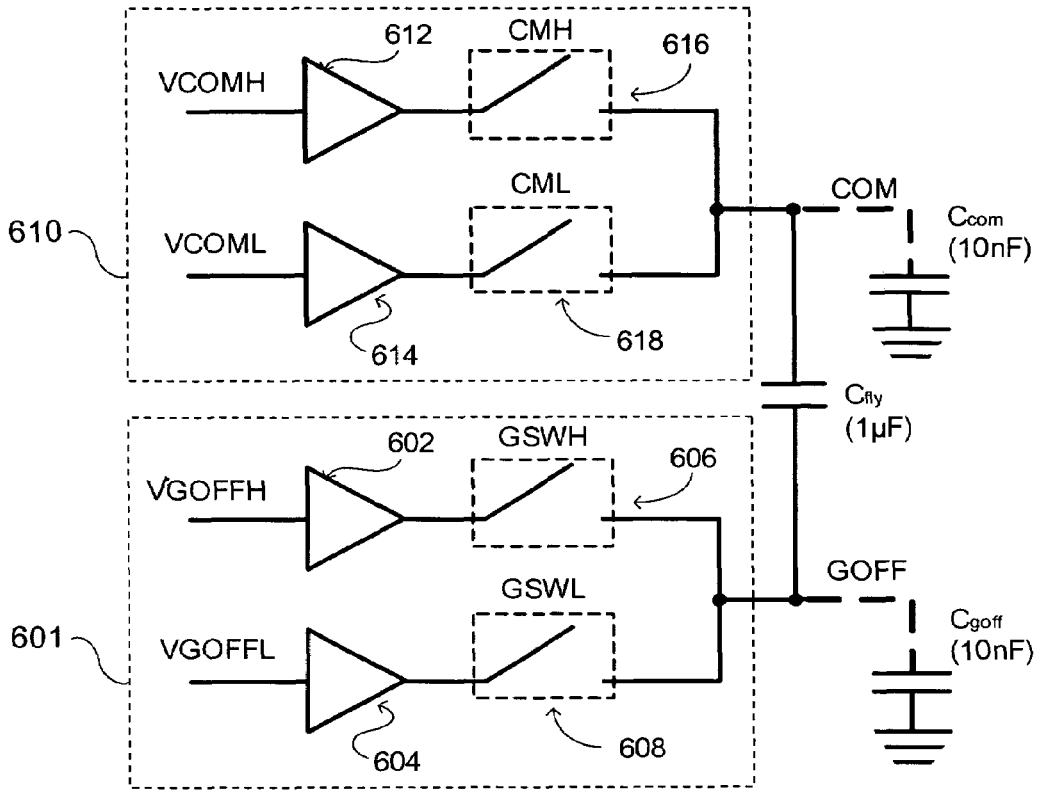
FIG. 6 is a diagram illustrating a driving circuit for providing a gate voltage (Vg) according to an embodiment of the present invention.

FIG. 6 illustrates a driving circuit 600 for providing a gate voltage (Vg) for driving cells of a Cs-on-gate type LCD panel according to an embodiment of the present invention. Driving circuit 600 includes a gate electrode driving circuit 601 including a VGOFFH buffer 602, a VGOFFL buffer 604, a GSWH switch 606, and a GSWL switch 608. VGOFFH buffer 602 applies a gate-on voltage VGON when turning ON the line of cells coupled to gate electrode driving circuit 601 and applies a high level of a gate-off voltage VGOFFH when the line of cells coupled to gate electrode driving circuit 601 is OFF. VGOFFL buffer 604 applies a gate-on voltage VGON when turning ON the line of cells coupled to gate electrode driving circuit 601 and applies a low level of a gate-off voltage VGOFFL when the line of cell coupled to gate electrode driving circuit 601 is OFF. The voltage level of the gate-off voltage VGOFF outputted to the line of cell is controlled by GSWH switch 606 and GSWL switch 608. When gate electrode driving circuit 601 drives non-inverted lines of LCD panel and the line of cell coupled to gate electrode driving circuit 601 is OFF, GSWH switch 606 is turned ON and GSWL switch 608 is turned OFF so that VGOFFH buffer 602 outputs VGOFFH to drive a capacitor load (Cgoff) of the line of cells coupled to gate electrode driving circuit 601. When gate electrode driving circuit 601 drives inverted lines of LCD panel and the line of cell coupled to gate electrode driving circuit 601 is OFF, GSWH switch 606 is turned OFF and GSWL switch 608 is turned ON so that VGOFFL buffer 604 outputs VGOFFL to drive the capacitor load (Cgoff) of the line of cell coupled to gate electrode driving circuit 601. Cgoff represents the total of the capacitances of Cgs of the line of cells coupled to gate electrode driving circuit 601.

Driving circuit 600 further includes a common electrode driving circuit 610 for applying a common voltage VCOM to a common electrode (COM) of each cell of an LCD panel as a reference voltage. Common electrode driving circuit 610 includes a VCOMH buffer 612 to provide a high level of a common voltage VCOMH and a VCOML buffer 614 to provide a low level of a common voltage VCOML. The voltage level of the common voltage VCOM outputted to the line of the cells coupled to common electrode driving circuit 610 is controlled by a CMH switch 616 and a CML switch 618. When common electrode driving circuit 610 drives non-inverted lines of the LCD panel, CMH switch 616 is turned ON and CML switch 618 is turned OFF so that VCOMH buffer 612 outputs VCOMH to drive a capacitive load (Ccom) of the line of cells coupled to common electrode driving circuit 610. When common electrode driving circuit 610 drives inverted lines of the LCD panel, CMH switch 616 is turned OFF and CML switch 618 is turned ON so that VCOML buffer 614 outputs VCOML to drive the capacitive load (Ccom) of the line of the cells coupled to common electrode driving circuit 610. Ccom represents an equivalent capacitance of the above-described capacitance Clc of the line of liquid crystal cells coupled to common electrode driving circuit 610.

Figure 7:
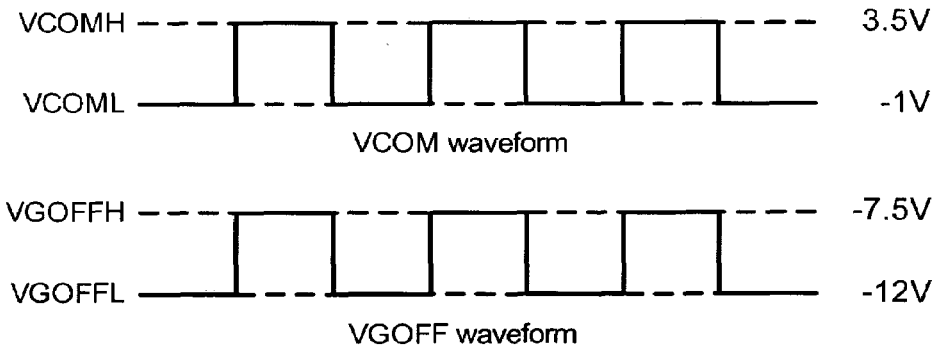
FIG. 7 is a diagram illustrating exemplary voltage levels of gate-off voltage (VGOFF) and common voltage (VCOM)

FIG. 7 is a diagram illustrating exemplary voltage levels of the gate-off voltage (VGOFF) and the common voltage (VCOM). In a Cs-on-gate type LCD panel employing the line common inversion driving method, the high/low level of the common voltage (VCOM) is in phase with that of the gate-off voltage (VGOFF). That is, when the common voltage (VCOM) is at a high voltage level VCOMH, the gate-off voltage (VGOFF) is at a high voltage level VGOFFH as well. When the common voltage (VCOM) is at a low voltage level VCOML, the gate-off voltage (VGOFF) is at a low voltage level VGOFFL as well. With reference to FIG. 7, the voltage level of VGOFFH is −7.5volt and the voltage level of VGOFFL is −12volt. The voltage level of VCOMH is 3.5volt and the voltage level of VCOML is −1volt. In the present embodiment, the difference between VCOMH and VCOML is the same as the difference between VGOFFH and VGOFFL.

Driving circuit 600 further includes an external flying capacitor (Cfly) coupled between the outputs of gate electrode driving circuit 601 and common electrode driving circuit 610. The capacitance of external flying capacitor (Cfly), e.g., 1 μF, is much larger than Ccom and Cgoff (e.g., 10 nF). In an LCD panel employing a line common inversion driving method, the high/low level of common voltages (VCOM) is in phase with that of the gate-off voltage (VGOFF). In this embodiment, when both the common voltage (VCOM) and the gate-off voltage (VGOFF) are at a high voltage level, external flying capacitor (Cfly) is charged by a potential difference of 11 volts between VCOMH (e.g., 3.5 volt) and VGOFFH (e.g., −7.5 volt). When both the common voltage (VCOM) and the gate-off voltage (VGOFF) are at a low voltage level, external flying capacitor (Cfly) is again charged by the potential difference of 11 volts between VCOML (e.g., −1 volt) and VGOFFL (e.g., −12 volt). Thus, the potential difference to charge external flying capacitor (Cfly) is substantially the same (i.e., 11 volt) in both cases. The capacitance of the external flying capacitor (Cfly) is large compared to that of Cgoff and Ccom. In addition, the potential difference between the common voltage (VCOM) and the gate-off voltage (VGOFF) to charge the external flying capacitor (Cfly) is large. In this embodiment, the external flying capacitor (Cfly) can be used to help gate electrode driving circuit 601 drive capacitive load (Cgoff). As a result, gate electrode driving circuit 601 needs less chip area as compared to the conventional gate electrode driving circuit. The power consumption of gate electrode driving circuit 601 should be smaller than that of the conventional gate electrode driving circuit. In addition, a response time needed to drive the capacitive load (Cgoff) can be reduced since the external flying capacitor (Cfly) provides an additional driving path to drive the capacitive load (Cgoff).

Figure 8:
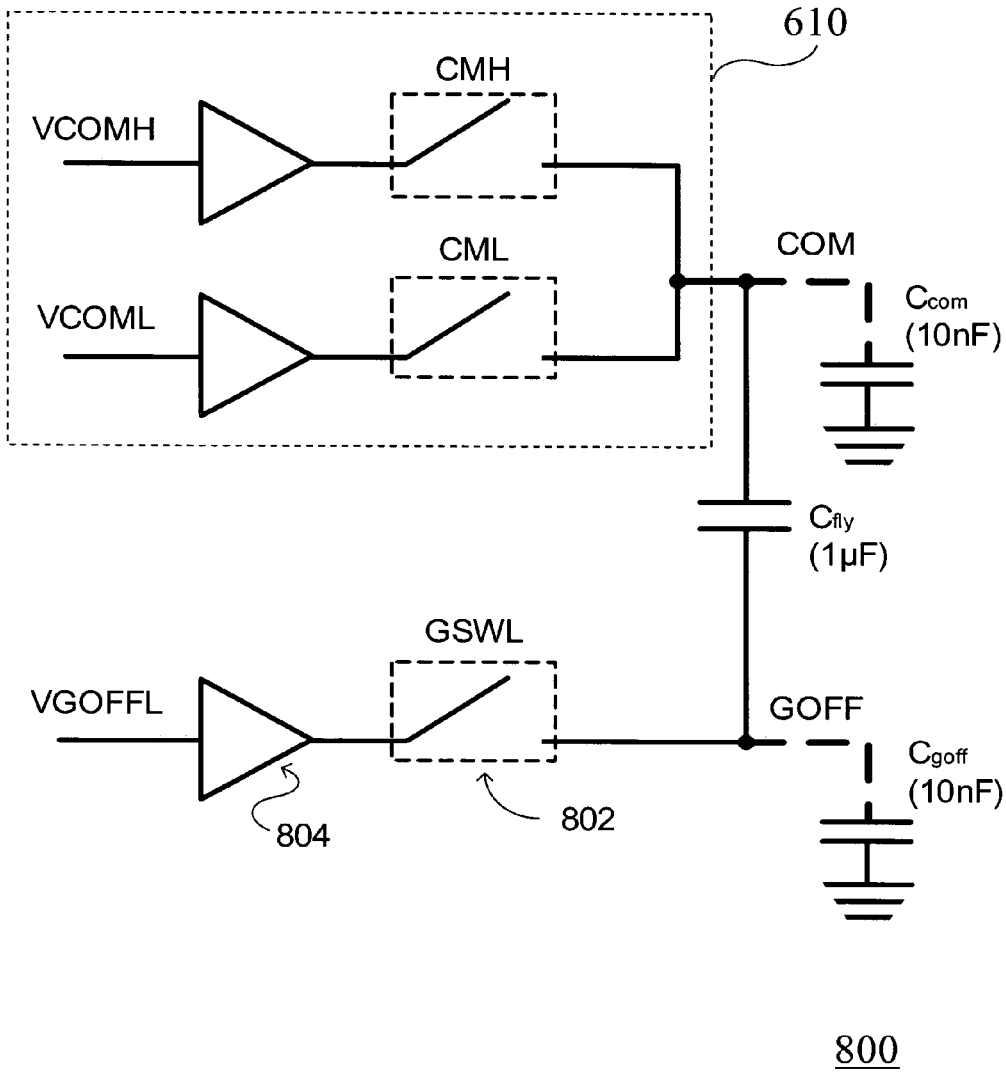
FIGS. 8 and 9 respectively illustrate two exemplary driving circuits for driving an LCD panel according to another embodiment of the present invention.
Figure 9:
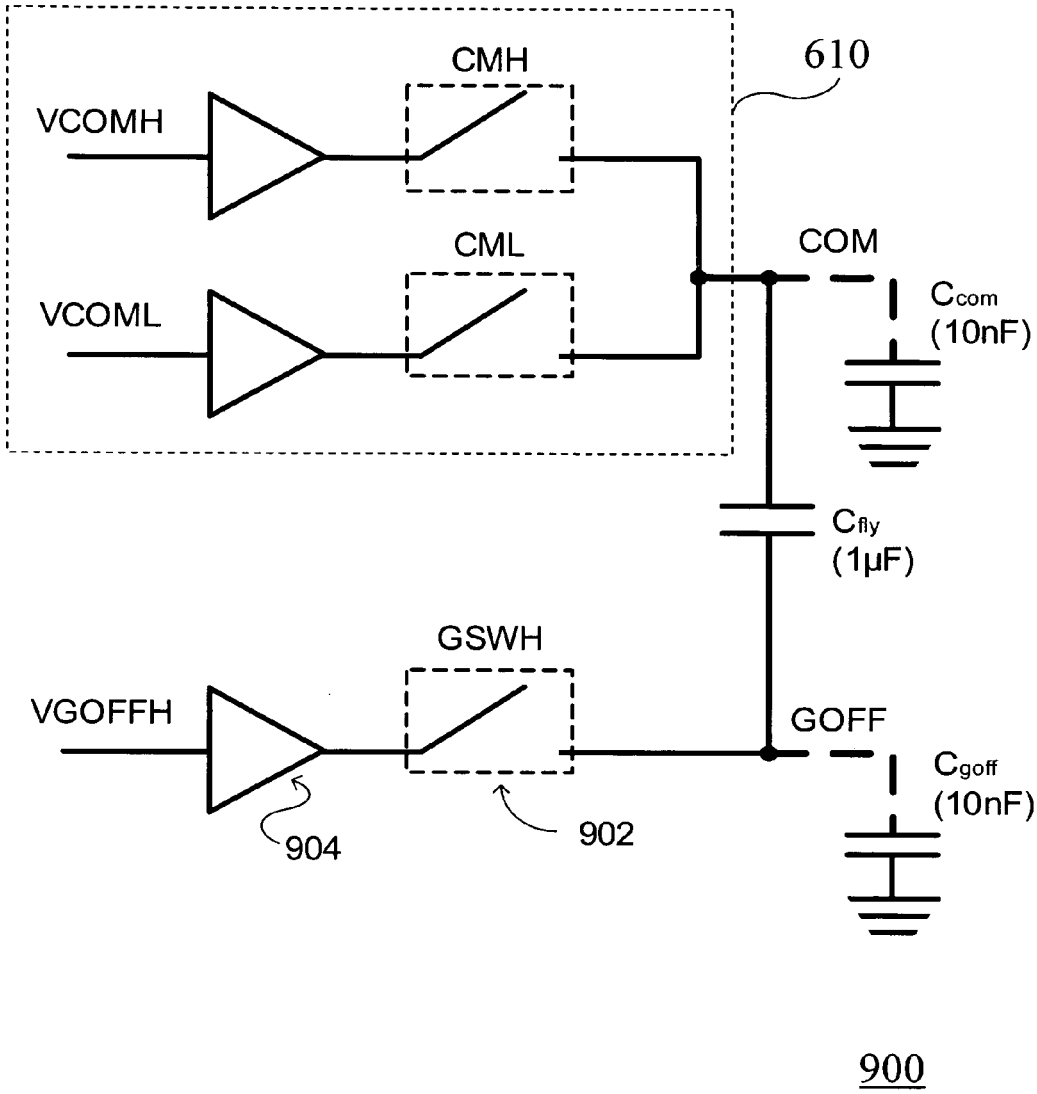

FIGS. 8 and 9 illustrate two exemplary driving circuits for driving a LCD panel according to another embodiment of the present invention. If the capacitance of external flying capacitor (Cfly) is large enough to provide a sufficient driving voltage to drive capacitive load (Cgoff), one of VGOFFH buffer 602 and VGOFFL buffer 604 can be omitted. FIG. 8 illustrates a driving circuit 800 in which such an omission is implemented. With reference to FIG. 8, a GSWL switch 802 and a VGOFFL buffer 804 correspond to GSWL switch 708 and VGOFFL buffer 704 of FIG. 7, respectively. Common electrode driving circuit 610 is the same as described with reference to FIG. 6. When GSWL switch 802 is turned ON, both VGOFFL buffer 804 and the external flying capacitor (Cfly) are used to provide a low level of gate-off voltage (VGOFFL) to drive the capacitive load (Cgoff). When GSWL switch 802 is turned OFF, only the external flying capacitor (Cfly) is used to provide a high level of gate-off voltage (VGOFFH) to drive the capacitive load (Cgoff).

FIG. 9 illustrates a driving circuit 900 in which the VGOFFL buffer is omitted. With reference to FIG. 9, a GSWH switch 902 and a VGOFFH buffer 904 correspond to GSWH switch 706 and VGOFFH buffer 702 of FIG. 7, respectively. Common electrode driving circuit 610 is the same as described with respect to FIG. 6. When GSWH switch 902 is turned ON, both VGOFFH buffer 904 and the external flying capacitor (Cfly) are used to provide a high level of gate-off voltage (VGOFFH) to drive the capacitive load (Cgoff). When GSWH switch 902 is turned OFF, only the external flying capacitor (Cfly) is used to provide a low level of gate-off voltage (VGOFFL) to drive the capacitive load (Cgoff). Thus, implementing either of driving circuits 800 or 900 requires less chip area. Additionally, implementing either of driving circuits 800 or 900 enables a reduction in power consumption.

In the embodiments described herein, an LCD panel employs a line common inversion driving method. However, the invention is not so limited. Driving circuits consistent with embodiments of the present invention can be implemented in an LCD panel employing a frame common inversion driving method in which the polarity of the potential difference is inverted every frame period as well. This is because the high/low level of common voltage (VCOM) is in phase with the gate-off voltage (Vgoff) in an LCD panel employing the frame common inversion driving method.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

We claim:

1. A driving circuit for driving a display panel, wherein the display panel includes a plurality of cells arranged in rows, comprising:

a gate electrode driving circuit to provide a gate voltage for driving a row of the cells;

a common electrode driving circuit to provide a common voltage to a common electrode of the row of cells, the common electrode driving circuit including:

a first buffer to provide a first level of the common voltage;

a second buffer to provide a second level of the common voltage;

a first switch to selectively couple the first buffer to an external capacitor;

a second switch to selectively couple the second buffer to the external capacitor; and wherein only one of the first and second switches is turned ON to couple one of the first and second buffers to the external capacitor; and wherein the external capacitor is coupled between the gate electrode driving circuit and the common electrode driving circuit, and is charged by a potential difference between the common voltage and the gate voltage.

2. The driving circuit of claim 1, wherein the gate electrode driving circuit further includes a third buffer to provide a first level of the gate voltage and a third switch to selectively couple the third buffer to the external capacitor.

3. The driving circuit of claim 2, the gate electrode driving circuit further including a fourth buffer to provide a second level of the gate voltage and a fourth switch to selectively couple the fourth buffer to the external capacitor, wherein only one of the third and fourth switches is turned ON to couple one of the third and the fourth buffers to the external capacitor.

4. The driving circuit of claim 3, a difference between the first and second levels of the common voltage is substantially the same as a difference between the first and second levels of the gate voltage.

5. A driving method for driving a display panel, wherein the display panel includes a driving circuit and a plurality of cells arranged in rows, the driving circuit comprising:

a gate electrode driving circuit to provide a gate voltage to a row of cells, the gate electrode driving circuit including a first buffer to provide a first level of the gate voltage, a second buffer to provide a second level of the gate voltage, a first switch to selectively couple the first buffer to an output of the gate electrode driving circuit, and a second switch to selectively couple the second buffer to the output of the gate electrode driving circuit; and a common electrode driving circuit to provide a common voltage to the row of cells, the common electrode driving circuit including a third buffer to provide a first level of the common voltage, a fourth buffer to provide a second level of the common voltage, a third switch to selectively couple the third buffer to an output of the common gate electrode driving circuit, and a fourth switch to selectively couple the fourth buffer to the output of the common electrode driving circuit, and an external capacitor coupled between the output of the gate electrode driving circuit and the output of the common electrode driving circuit to provide an additional gate voltage to the row of cells;

the method comprising:

turning ON the first and the third switches to respectively couple the first buffer and the third buffer to the external capacitor to charge the external capacitor with a difference between the first level of the common voltage and the first level of the gate voltage; and turning ON the second and the fourth switches to respectively couple the second buffer and the fourth buffer to the external capacitor to charge the external capacitor with a difference between the second level of the common voltage and the second level of the gate voltage;

wherein only one of the first and second switches is turned ON and only one of the third and fourth switches is turned ON.

6. A driving method for driving a display panel, wherein the display panel includes a driving circuit and a plurality of cells arranged in rows, the driving circuit comprising:

a gate electrode driving circuit to provide a gate voltage to a row of cells, the gate electrode driving circuit including a first buffer to provide a first level of the gate voltage, and a first switch to selectively couple the first buffer to an output of the gate electrode driving circuit, and a common electrode driving circuit to provide a common voltage to the row of cells, the common electrode driving circuit including a second buffer to provide a first level of the common voltage, a third buffer to provide a second level of the common voltage, a second switch to selectively couple the second buffer to an output of the common gate electrode driving circuit, and a third switch to selectively couple the third buffer to the output of the common electrode driving circuit; and an external capacitor coupled between the output of the gate electrode driving circuit and the output of the common electrode driving circuit to provide an additional gate voltage to the row of cells;

the method comprising:

turning ON the first and the second switches to respectively couple the first buffer and the second buffer to the external capacitor to charge the external capacitor with a difference between the first level of the common voltage and the first level of the gate voltage; and turning ON the third switch to couple the third buffer to the external capacitor to charge the external capacitor with the second level of the common voltage;

wherein only one of the second and third switches is turned ON.

* * * * *